United States Patent [19]

Buchanan et al.

[11] 4,290,209

[45] Sep. 22, 1981

[54] DRYER FABRIC

[75] Inventors: John G. Buchanan; Donald G. MacBean, both of Ottawa, Canada

[73] Assignee: Jwi Ltd., Montreal, Canada

[21] Appl. No.: 140,475

[22] Filed: Apr. 15, 1980

Related U.S. Application Data

[63] Continuation of Ser. No. 906,434, May 17, 1978, abandoned, which is a continuation-in-part of Ser. No. 846,355, Oct. 28, 1977, abandoned.

[51] Int. Cl.[3] ..... F26B 13/08

[52] U.S. Cl. ..... 34/123; 34/243 R; 139/383 A; 139/420 A

[58] Field of Search ..... 34/116, 111, 121, 123, 34/110, 95, 243 R; 245/8; 139/425 R, 425 A, 383 A, 383 B, 420 R, 420 A; 162/DIG. 1, 348, 358

[56] References Cited

U.S. PATENT DOCUMENTS

| | | | |
|---|---|---|---|
| 2,132,252 | 10/1938 | Weber | 139/425 |
| 2,260,940 | 10/1941 | Hall | 139/412 |
| 2,841,882 | 7/1958 | Hornbostel | 34/121 |
| 3,555,700 | 1/1971 | Wagner | 34/116 |
| 4,142,557 | 3/1979 | Kositzke | 139/425 A |

*Primary Examiner*—Larry I. Schwartz

*Attorney, Agent, or Firm*—Alan Swabey; Robert Mitchell; Guy Houle

[57] ABSTRACT

An improved dryer fabric, woven entirely from monofilament plastic polymeric warp and weft strands, having a lower permeability to air flow and lower modulus of elasticity than normal fabrics, wherein at least the warp strands are flattened in cross-section, with the long axis of the flattened section extending parallel to the plane of the fabric and wherein the weft strands may be shaped so as to more or less conform to the horizontally directed passages of the mesh naturally formed by the woven warp strands and may also be relatively more malleable than the warp strands so that under stress they can adapt to conform to the shape of mesh interstices thereby to restrict these and still further reduce the permeability.

15 Claims, 15 Drawing Figures

Fig. 6
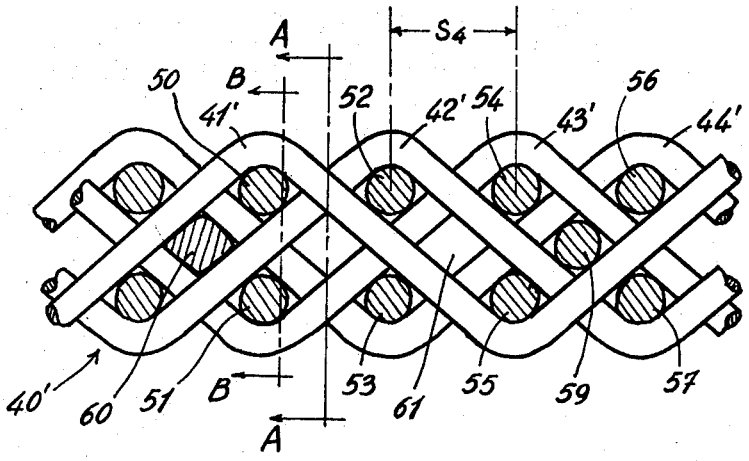
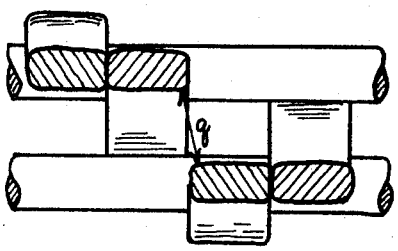
Fig. 6A
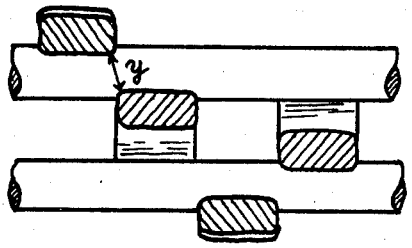
Fig. 6B

DRYER FABRIC

CROSS-REFERENCE TO RELATED APPLICATION

This is a continuation of application Ser. No. 906,434 filed May 17, 1978 now abandoned which in turn is a CIP of U.S. Ser. No. 846,355 filed Oct. 28, 1977 now abandoned.

BACKGROUND OF INVENTION (a) Field of the Invention

This invention relates to fabrics as used in the dryer sections of paper making machines.

(b) Description of Prior Art

In the manufacture of paper on a Fourdrinier paper making machine, for example, an aqueous suspension of cellulose fibres, comprising one part or less fibres in 99 parts or more of water by weight, is flowed on to an endless rotating forming screen woven of metal or synthetic filaments. As this belt, or forming fabric or "wire", as it is called, passes over water extraction devices such as table rolls, drainage foils and suction boxes, the water content of the suspension supported on the fabric is reduced to about 80 to 85 percent.

The thin web of fibres, now self supporting, is removed from the forming fabric and passes to a series of one or more press sections where it is deposited on other endless belts of relatively thick fabric, one or both surfaces of which may be composed of a needled bat of synthetic or natural fibres. These belts, called wet felts carry the web through the nips of press rolls where more of the water remaining in the web is squeezed into the absorbent felts until the water content is lowered to about 65% at which point it is not generally practical to attempt further water removal by direct extraction such as with pressure or vacuum.

The web of paper is then passed to the dryer section of the machine where the remainder of the water is removed by an evaporation process accelerated by the application of heat. The dryer section consists of a number of large, hollow cast iron or steel cylinders over which the paper web passes in a serpentine fashion. The cylinders are rotated synchronously to facilitate the passage of the web. Heat is supplied by steam condensing inside each cylinder and the web is held in intimate contact with portions of the heated surfaces of the dryer cylinders by the dryer fabrics.

To provide sufficient drying capacity a newsprint dryer section, for example, may consist of about 50 dryer cylinders each about 5 feet in diameter and set up in an upper and lower tier in four or five individual subsections.

In order to appreciate the magnitude of the dryer section of a modern paper making machine, the overall size may be about 200 feet long, up to 40 feet wide and up to 40 feet high. The paper web may pass through the dryer section at speeds up to 3000 feet per minute so that any part of the web may only remain in the dryer section for as little as 15 seconds during which time the web will be reduced to a normally dry sheet of paper.

The dryer fabrics serve to hold the paper web against the heated surfaces of the rotating dryer cylinders to promote more effective heat transfer to the web by partially eliminating a heat insulating layer of air which adheres to the surface of the cylinders. The drier fabrics also serve to prevent the paper web from wrinkling.

In the conventional dryer section there is an upper and a lower dryer fabric. The upper fabric wraps around and holds the paper web against the upper peripheries of the upper dryer cylinders while the lower fabric wraps around and holds the paper web against the lower peripheries of the lower dryer cylinders. The fabrics are guided by intermediate fabric rolls placed between the cylinders.

Dryer fabrics operate in a particularly adverse environment in which they are alternately exposed to hot and wet and hot and dry conditions. They must be flexible in the machine direction so that they can bend around the felt rolls easily. They must have good dimensional stability and durability under the conditions of tension, temperature and humidity which prevail in the dryer section of a paper machine. Generally, dryer fabrics are woven from either natural or synthetic yarns to form a relatively bulky fabric that will have good absorbent characteristics and high porosity to enhance removal of moisture from the web of paper. To attain these results the yarns are woven closely together and sometimes in several plies to form a comparatively impermeable fabric. To decrease permeability further sometimes bulky staple fibre yarns, some containing asbestos, are woven in. These fabrics thus exhibit an undesirable tendency to hold sufficient water to rewet the sheet. They also become increasingly difficult to clean of various foreign substances such as sizing agents, clay-like fillers and resins, gums, waxes and pitch and the fabric becomes plugged up so that it has to be cleaned frequently or repaced.

Dryer fabrics are usually woven with approximately 100% warp fill, as shown in the drawings of this application and as is well known to those skilled in the art. Warp fill is defined as the amount of warp in a given space relative to the total space considered. Warp fill can be over 100% when there are more warp strands jammed into the available space than the space can dimensionally accommodate in a single plane. Fabrics having a nominal warp fill of approximately 100% will generally have an actual calculated warp fill of from 80% to 125% as is the fabric of this invention. Values over 100% are brought about by crowding and lateral undulation of the warp strands.

Permeability is an important characteristic of a dryer fabric and is a measure of its air passage capability. A low permeability fabric will resist the passage of air and tend to absorb vapour whereas a high permeability fabric will allow free passage of air and vapour.

As indicated previously dryer fabrics were conventionally made from cotton or wool and sometimes contained asbestos fibres. With the development of synthetic yarn materials the conventional fabrics are gradually being replaced by fabrics containing synthetic yarns. These may be woven in simple or in very complex weaves in two or three plies or more of either relatively large diameter monofilament yarn or of multifilament yarns spun from many small diameter filaments.

Of the new synthetic yarns monofilaments are preferred because the resultant fabric has increased running life, is easy to clean, does not shed fibre and does not carry excessive moisture. During the part of the cycle when the fabric is in contact with the sheet over a dryer cylinder, low moisture content and high permeability enhance transfer of heat to the web. Also, the high permeability of the fabric can have a beneficial effect on ventilation of the dryer pockets, producing a more even moisture profile in the web. However, the high permeability of fabrics made from all-monofilament yarns in some cases is a disadvantage as it causes excessive air movement in dryer pockets which results in sheet flutter. This problem increases with machine speed and a point is soon reached when the flutter, particularly in the first and second dryer sections where the web is wet and weak, is violent enough to cause it to break.

The effect of fabric permeability on dryer pocket ventilation and sheet flutter has been described by Race, Wheeldon, et al (Tappi, July 1968 Vol. 51 No. 7) and they have shown that air movement in dryer pockets is influenced by permeability rather than by the surface roughness of the fabric as was previously supposed. Air movement in dryer pockets is induced by the fact that a moving fabric carries with it layers of air. At the surface of the fabric the velocity of the air layer is the same as that of the fabric and as the distance from the surface of the fabric increases the velocity of the air decreases. When the fabric wraps around a roll, the layer of air on the inside is trapped in the nip between the roll and the fabric and, if the fabric is sufficiently permeable, the air from the inside is pumped through, joins the air stream on the outside of the fabric and the combined velocity of the two streams is greater than the speed of the fabric. As the fabric passes around the roll the layers of air on the outside tend to be thrown outward by centrifugal force generating tangential air movement. This results in a large mass of air moving laterally out of the pockets when high permeability fabrics are used on high speed machines.

The Race, Wheeldon et al experiments show that as fabric speed increases, the air which is pumped through the fabric by the felt rolls of the dryer increases in velocity, particularly at speeds above 1500 r.p.m. They also show that as fabric permeability is reduced, the amount of air pumped into the dryer pockets is correspondingly reduced. Thus at low speeds a dryer fabric with high permeability can be tolerated and, in fact, is useful in achieving high drying rates, but at high speeds, particularly in the first or second dryer sections, it is necessary to have low permeability fabrics in the range of 50 to 200 cu.ft./min./sq.ft. Thus on high speed machines it is often not practical to take advantage of the easy to clean characteristic of monofilament fabrics because of their inherent high permeability.

"Permeability" is usually expressed by the number of cubic feet of air per minute passing through a square foot of the fabric when the pressure drop across it is 0.5 inches of water. One instrument used to measure air permeability is a Frazier Air Permeometer.

In this instrument air is drawn by a variable speed run through a 1 square inch section of fabric to be tested then through upper and lower chambers joined by one of a set of replaceable orifices calibrated for measuring volume by pressure differential. The speed of the fan is increased until the upper chamber reaches a vacuum of 0.5 inches of water as indicated on a manometer. The vacuum, in inches of water, in the lower chamber is then read off another interconnected monometer and this value is applied to a reference graph to convert the reading to cubic feet of air per minute per square foot of fabric.

While in the conventional dryer system, the problem of sheet flutter may be overcome by using a dryer fabric having low permeability, another method of alleviating this problem is known as the single fabric dryer system. In this method, a single dryer fabric is used to guide the web of paper in serpentine fashion through the dryer sections of the paper machine. The paper, for example, is introduced under the fabric at the first upper cylinder and passes substantially in contact with the fabric all through a dryer section so that it lies between the fabric and the cylinders in the upper tier and outside the fabric around the cylinders in the lower tier.

The main advantage of the single fabric dryer system is that the web of paper is partially supported by the fabric as it passes between the tiers of dryer cylinders and sheet flutter is thereby reduced or may be entirely eliminated.

Other important advantages of the single fabric dryer system include reduction of dryer fabric costs and elimination of felt rolls and one set of stretch and guide rolls which are no longer required. Also, since the lower tier of cylinders is not encumbered by a separate lower dryer felt, the waste paper from paper breaks, or "broke" as it is called, may be removed more easily.

A disadvantage of the single fabric system is that when it is applied to existing dryer sections in which all the dryer cylinders are the same size and are driven at the same rotational speed by an interconnected set of gears, the conventional monofilament fabric having a high modulus of elasticity, is quite inextensible and will try to force the upper cylinders, which have a larger effective diameter due to the layer of paper, to turn at a lower rotational speed. This braking action of the cylinders by force tending to stretch the fabric, produces considerable stress on the drive train and even when the web of paper is fairly thin, the stress has been sufficient to cause abnormal wear of the gear teeth and bearings and in some cases structural failure.

The stretch of the fabric, called fabric draw, caused by the difference in fabric path lengths over the cylinders is within the elastic range of the fabric and is proportional to the thickness of the web of paper. The stress, expressed in terms of torque, on the dryer cylinder gears, is proportional to the product of the paper thickness and the modulus of elasticity of the fabric. As a practical example, in a single fabric dryer section where the paper web is only 0.012 inches thick the calculated torque developed at the drive gear of an upper cylinder will amount to 3000 ft.-lbs. From this it will be apparent that the problem of gear wear and structural failure will be significantly alleviated by using a fabric having a lower modulus of elasticity so that it stretches more easily and can absorb the stress developed by differentials in dryer cylinder diameter due to paper thickness.

While the above example illustrates the degree of stress that can be developed by a relatively thin web of paper, it will be appreciated that differences in dryer cylinder diameters caused by wear or by thermal expansion due to temperature differentials may also have destructive effects which can be alleviated by using a dryer fabric having a lower modulus of elasticity.

The stress problem can be overcome in those cases where it is possible to disconnect the upper gear train from the lower gear train so that either the upper or the lower cylinders only are driven. In such cases the cylinders which are disconnected are rotated by the dryer fabric and it doesn't matter if they rotate at a different speed. There are some installations, however, in which it is not possible to disconnect some of the drive gears and it is in these cases where a fabric having low modulus of elasticity will be used to advantage.

A further disadvantage of the single fabric dryer system arises because of the relative thickness of a conventional fabric. For example, when the wet web of paper passes from an upper dryer cylinder where it lies under the fabric, to a lower dryer cylinder where it lies over the fabric, it is stretched due to the difference in diameters. This stretch, or paper draw, is proportional to the thickness of the fabric. Since it is easily extensible the wet web of paper will accommodate to the draw. However, as it progresses from a lower dryer cylinder to an upper dryer cylinder a negative draw is created and because the wet web of paper is non-elastic it separates from the fabric and billows out so that it can fold or overlap on itself before passing under the fabric at the upper dryer cylinder, thus nullifying the effect of the support of the fabric. It will be apparent therefore that it is advantageous to use the thinnest possible dryer fabric in the single fabric system.

SUMMARY OF INVENTION

The present invention provides a dryer fabric, for use on a papermaking machine, having reduced permeability and reduced modulus of elasticity. Said dryer fabric comprises a plurality of interwoven monofilament plastic polymeric warp and weft strands wherein at least the warp strands, which extend in the machine direction, have a flattened cross-section the long axis of which lies parallel to the plane of the fabric. The fabric of this invention has the advantages of being easy to clean and being non-absorptive.

An important feature of the flattened warp is that it has a near rectangular cross-section which has a lower resistance to bending about its long axis than a circular cross-section of the same area and therefore, for the same strength of loom blow during weaving, the spacing of the weft strands can be reduced greatly compared with the spacing when woven with circular warp. Also, because of the lower profile of the flattened warp, the diagonal apertures in the mesh which allow the passage of air are thereby reduced in size.

A further feature of the flattened warp is that with the long axis of the rectangular cross section being parallel to the weft yarns, the fabric is made more resistant to distortion in its own plane while permitting easy flexing of the fabric about the axis which is parallel to the weft strands, thus, making it easier for the fabric to flex around dryer cylinders and smaller diameter rolls in the dryer system.

Although reduced permeability is essentially attained by using flattened warp, further reduction in permeability, also a feature of the invention, may be attained by the use of monofilament weft strands that are shaped in cross-section so as to substantially conform to the horizontally directed intersticial weft direction passages of the mesh naturally formed by the woven warp strands to thereby reduce the space between adjacent weft strands.

The invention also features the use of round or shaped weft which is relatively malleable as compared to the warp so that during the weaving process, and subsequently under any stressful condition, it will tend to adapt itself to the shape of mesh interstices to thereby restrict them and reduce permeability further still.

A further feature of the invention is the use of round or shaped polymeric weft, that is hollow (tubular) so that it may more easily adapt itself to conform to the shape of the mesh interstices.

An important advantage of the flattened monofilament warp, either with round or with shaped monofilament weft, is that it provides low permeability in an all-monofilament dryer fabric without the necessity of adding bulked yarns, as described in Canadian Pat. No. 861,275, which absorb dirt and moisture, or adding bulky weft yarns comprising fine staple fibres which are low in bending resistance and contribute to reduced resistance of the fabric to distortion in its own plane.

Another advantage obtained in using flattened warp strands is that the points of contact, or cross-overs, between warp and weft (contact area between weft and warp) are increased which serves to help stiffen the fabric against distortion in its own plane.

A still further advantage of the flattened warp according to this invention is that the fabric from which it is woven is relatively thin and has been found to have an elastic modulus that is only about one half that of similar fabric woven of conventional round warp. As explained above, low thickness caliper and low modulus of elasticity is particularly advantageous if the fabric is to be used in a single fabric dryer system.

According to the above features, from a broad aspect, the present invention provides a dryer fabric for use in a paper making machine comprising a plurality of interwoven warp and weft monofilament plastic polymeric strands woven with approximately 100% warp fill. At least the warp strands, which extend in the machine direction, have a flattened cross-section with the long axis of the cross-section extending parallel to the plane of the fabric. The lowered profile of the flattened strands define restricted diagonal apertures in the mesh of the fabric to thereby reduce the permeability of the fabric uniformly throughout.

The weft strands, which extend in the cross-machine direction, may have either a round cross-section or a cross-section shaped to substantially conform to weft passages of the mesh naturally formed by the warp strands to further reduce permeability. As a further embodiment of the invention some or all of the weft strands may be hollow plastic strands or strands formed of plastic material which is relatively malleable as compared to the material of the warp strands so that they can adapt to conform to the shape of mesh interstices to partially fill these and still further reduce permeability of the fabric.

The fabric of this invention having the lowest permeability will have, besides flattened warp, weft strands shaped to substantially conform to weft passages of the mesh and weft strands that are relatively malleable as compared to the warp strands.

BRIEF DESCRIPTION OF DRAWINGS

A preferred embodiment of the present invention will now be described with reference to the examples illustrated by the accompanying drawings in which:

FIG. 6 is an enlarged sectional view of a dryer fabric as shown in FIG. 5 but utilizing the flattened warp strands to obtain the improved dryer fabric of the present invention;

FIGS. 6A and 6B are sectional views along section lines A—A and B—B of FIG. 6;

DESCRIPTION OF PREFERRED EMBODIMENTS

Figure 1:
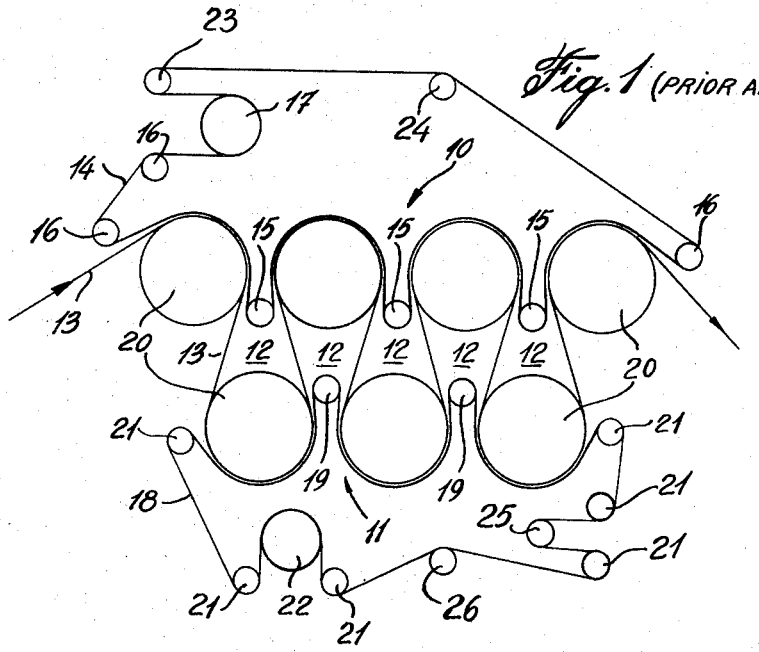
Fig. 1 (PRIOR ART)
FIG. 1 is a schematic view of a typical dryer section as used in a papermaking machine.

Referring to FIG. 1 there is schematically illustrated a sub-section of a typical dryer section in a papermaking machine (not shown). The top tier dryer cylinders are generally indicated at 10 and the bottom tier at 11. The paper web 13 passes in a serpentine fashion over the top and bottom dryer cylinders as shown. An endless top fabric 14 holds the paper web 13 tightly against the upper cylinders 10 as it passes partially around the first upper cylinder around a felt roll 15, partially around the remaining top cylinders 10 and around the other intervening felt rolls 15 then around return roll 16, passing over guide and tensioning rolls 24 and 23, respectively and over a steam heated dryer roll 17 to remove some of the residual moisture in the fabric and then over other return rolls 16, before it passes again over the first dryer cylinder to complete the cycle. Similarly an endless bottom fabric 18 holds the paper web 13 tightly against the lower dryer cylinders 11 as it passes around these and the intervening bottom felt rolls 19, return rolls 21, tensioning roll 25, guide roll 26, bottom fabric dryer roll 22 and other return rolls 21, substantially as shown. The areas, bounded by the paper web 13 both approaching and leaving a dryer cylinder and the dryer fabric as it leaves the previous cylinder, wraps a felt roll and approaches the next dryer cylinder, are called pockets 12. It is in these pockets 12 that a large quantity of the moisture is evaporated from the heated web of paper. Proper ventilation of the pockets 12 provides for removal of the moisture from the system and maintains the equilibrium of the evaporation process.

Figure 2:
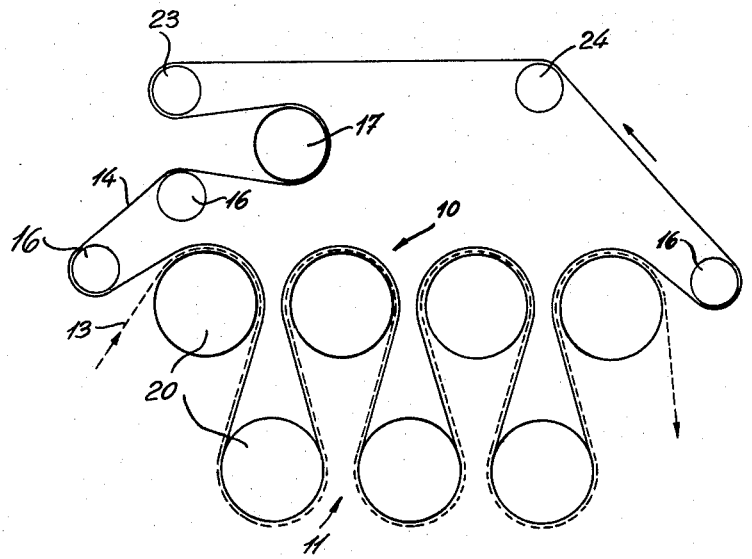
Fig. 2 (PRIOR ART)
FIG. 2 is a schematic view of a typical single fabric dryer section.

FIG. 2 represents, schematically, a typical dryer section in which all the cylinders are substantially the same diameter and are driven at the same number of revolutions per minute by interconnected gearing. As in FIG. 1, the upper tier dryer cylinders are generally indicated at 10 and the lower tier at 11. A single endless fabric, 14, passes in serpentine fashion around the first upper cylinder, down around the first lower cylinder, up around the second upper cylinder, down around the second lower cylinder and so on, then it passes around a return roll 16, a guide roll 24, a tensioning roll 23, a steam heated dryer roll 17 and other return rolls 16, as shown. The paper web 13 is introduced under the fabric at the first upper cylinder and follows the fabric, passing between it and the upper cylinders and outside the fabric at the lower tier cylinders. It will be seen that in respect to the fabric, because of the thickness of the paper web, the effective diameter at the upper cylinders is now larger than the diameter at the lower cylinders by an amount equal to twice the thickness of the paper web.

Figure 3:
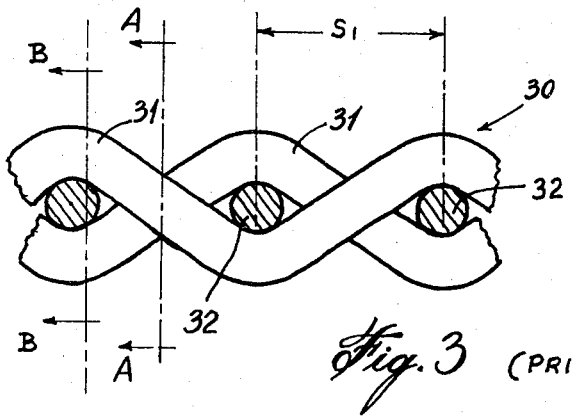
Fig. 3 (PRIOR ART)
FIG. 3 is an enlarged sectional view of a portion of a dryer fabric illustrating interwoven weft and warp monofilament circular strands as presently utilized.
Figure 3A:
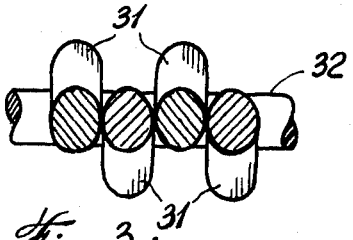
Fig. 3A (PRIOR ART)
FIGS. 3A and 3B are cross-sectional views along section lines A—A and B—B of FIG. 3.
Figure 3B:
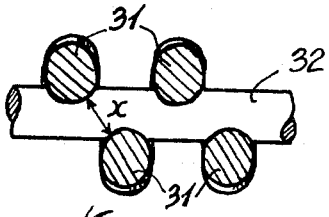
Fig. 3B (PRIOR ART)

FIG. 3 shows generally at 30, a plain weave synthetic fabric structure of the prior art in which numeral 31 denotes consecutive warp strands and numeral 32 denotes consecutive weft strands. In this structure each warp strand 31 passes over a first weft strand 32, under the second weft strand, over the third and so on. Similarly, the adjacent warp strand passes under the first weft strand, over the second, under the third and so on. $S_1$ denotes the center-to-center distance between adjacent weft strands 32. In FIG. 3B "x" denotes the shortest distance between adjacent warp strands 31 in the vertical section taken at the point of tangency between warp and weft, thus representing the largest diagonal aperture which permits passage of air through the fabric 30.

Figure 4:
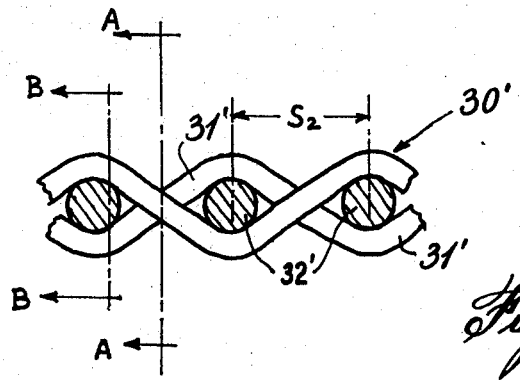
FIG. 4 is an enlarged sectional view of a fabric structure similar to that as shown in FIG. 3 but utilizing the flattened cross-section warp strands forming the improved dryer fabric of the present invention.
Figure 4A:
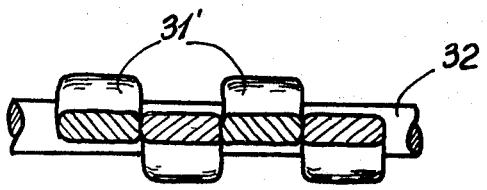
FIGS. 4A and 4B are sectional views along cross-section lines A—A and B—B of FIG. 4.
Figure 4B:
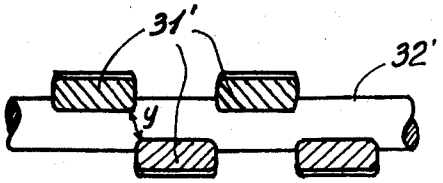

Referring now to FIGS. 4, 4A and 4B there is shown the same fabric structure 30' made with warp monofilament strands 31' that have been flattened to the extent that its short axis "b" (see FIG. 7) is only about half ($\frac{1}{2}$) the diameter of round warp 31 of corresponding cross-sectional area.

In comparing the fabrics of FIGS. 3 and 4, it will be apparent that, due to the lower resistance to bending of the rectangular cross-section, the flattened warp 31' assumes a crimp more easily so that the center-to-center distance between weft strands, $S_2$ of FIG. 4, is smaller than $S_1$ of FIG. 3. Also, because of the flat profile of the flattened warp the distance "y" in FIG. 4B is noticeably less than the corresponding distance "x" in FIG. 3B. Similarly, because of the reduced spacing of weft strands 32', distance $S_2$, the area of the roughly triangular interstice based on "y" in FIG. 4B is much smaller than that based on "x" in FIG. 3B.

Figure 5:
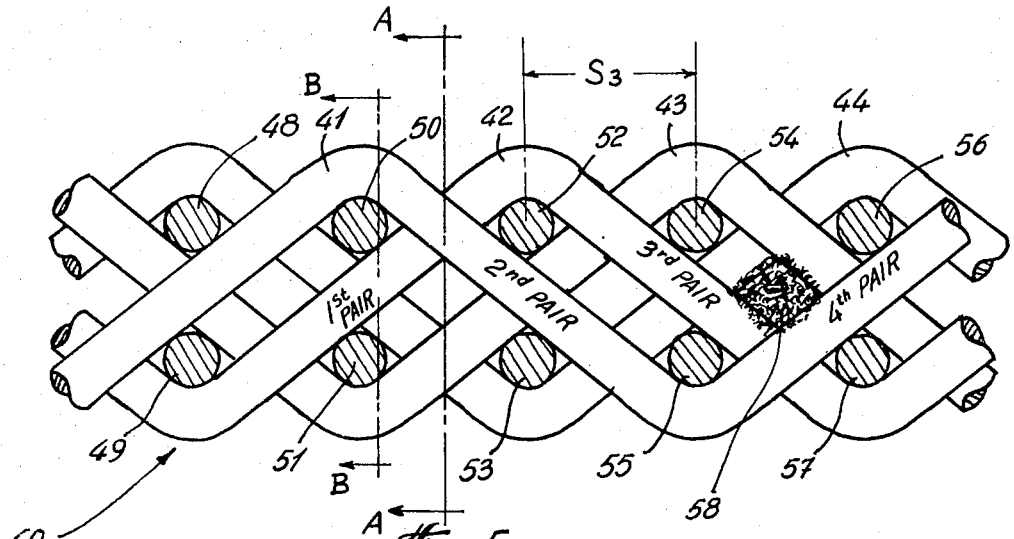
Fig. 5 (PRIOR ART)
FIG. 5 is an enlarged sectional view of an all monofilament 4-shaft 8 repeat duplex weave dryer fabric of the prior art.
Figure 5A:
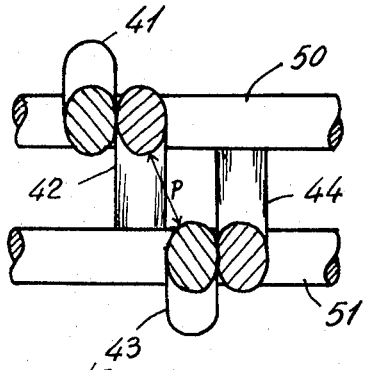
Fig. 5A (PRIOR ART)
FIGS. 5A and 5B are sectional views along section lines A—A and B—B of FIG. 5.
Figure 5B:
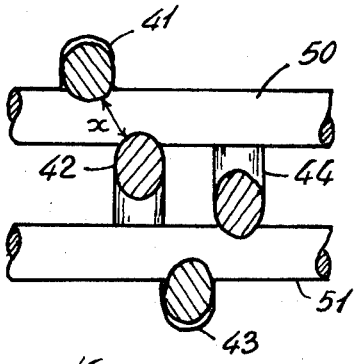
Fig. 5B (PRIOR ART)

FIGS. 5, 5A and 5B depict an all monofilament 4-shaft 8 repeat duplex weave dryer fabric 40, a type which is commonly used in the papermaking industry. In FIG. 5, numerals 41, 42, 43 and 44 are consecutive warp strands. The weft is paired in two layers and numbered 48 to 57 as shown. In this structure a warp strand 41 passes in order over a first pair of weft strands 50–51, between the second pair 52–53, under the third pair 54–55, between the fourth pair 56–57 and so on. The next consecutive warp strand passes between the first pair of weft strands, over the second pair, between the third pair and under the fourth pair. Similarly, the third and fourth consecutive warp strands are woven commencing under and between the first pair of weft strands respectively.

$S_3$ denotes the center-to-center distance between pairs of weft strands, 52,53 and 54,55 and "x" (see FIG. 5B) is again the shortest distance between adjacent warp strands in the vertical section taken at the point of tangency between warp and weft. Referring to FIG. 5A, P denotes the shortest distance between crossing pairs of warp strands taken in a vertical plane midway between pairs of weft strands.

Typically the conventional fabrics of FIG. 5, in the mesh ranges commonly used, yield air permeabilities in the range between 400 and 900 cu.ft./min./sq.ft. In order to reduce permeability in this type of construction as indicated above, it is common to add bulky yarns between some of the monofilament weft strands as shown at 58 in this figure. Bulky yarns are normally made from staple fibres which fluff out and fill the space between the wefts.

FIGS. 6, 6A and 6B show the same fabric 40' as illustrated in FIG. 5 but with the warp strands 41'–44' flattened as in FIG. 4. It will again be apparent that the distances $S_4$ and "y" in FIGS. 6 and 6B are less than the corresponding distances $S_3$ and "x" in FIGS. 5 and 5B. The distance "q" in FIG. 6A is not appreciably different from the corresponding distance "p" in FIG. 5A, but again due to the reduced spacing $S_4$ the area of the interstice bounding "q" is much less than the area of the interstice bounding "p".

As also shown in FIG. 6, we provide, as an alternative to bulky staple fibre yarns, extra monofilament strands 59 woven into the fabric. As further illustrated in FIG. 6, the extra strands may have a diamond or rectangular shaped cross-section, shown at 60, to further fill the passages 61 of the fabric without making the fabric susceptible to picking up more foreign substances or retaining more water. Although not shown, when three or more layers of weft strands 50, 51 are provided, two or more passages 61 will be formed in the area between adjacent pairs of weft strands, i.e. in the area delineated across the fabric between the distance $S_4$, some or all of these passages may be filled with the shaped weft of the invention.

Further, all the weft strands may be made of plastic polymeric material that is more malleable whereby under stress in the wearing or other treatment of the fabric, the weft strands will deform to further fill the interstices of the mesh to still further reduce the permeability of the fabric.

In the case of each of these types of fabric the reduction in the dimensions $S_2$ and $S_4$ and "X" to "Y" results in a reduction insize of the interstices of the fabric and, therefore, a reduction in permeability. By the use of suitably flattened monofilament warp strands and with suitably shaped and possibly either hollow or more malleable weft strands the permeability of the fabric can be reduced to the 50 to 250 cu.ft./min./sq.ft. range without resorting to the use of fluffy bulked "stuffer" yarns with their attendant disadvantages.

Typical conventional monofilament dryer fabric, as shown in FIG. 5, has a thickness usually greater than 0.070 inches and an elastic modulus greater than 5000 lbs. per inch. Experimental fabric woven according to the invention as shown in FIG. 6, having warp strands flattened in the ratio of 2:1 and heat set in the normal way had an average thickness of 0.058 inches and an average modulus of elasticity of 2690 lbs. per inch. In general, fabric woven according to the invention will have a thickness within the range 0.035 to 0.070 inches and modulus of elasticity from 1500 to 3000 lbs. per inch.

Figure 7:
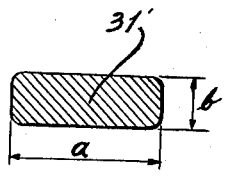
FIG. 7 is an enlarged cross-section view of the flattened monofilament warp strand as utilized in the dryer fabric of the present invention.

The warp yarns and the shaped weft yarns of the present invention may be made by mechanical rolling apparatus for rolling round monofilament strands in the range of 0.2 mm to 1.0 mm in diameter between pairs of rolls in order to flatten them or similarly flat or shaped strands may be extruded from a specially shaped die or made by the use of slit film to produce ribbons of monofilament-like material. The flattened cross-sectional shape of a monofilament strand is shown at FIG. 7, in which "a" is the width and "b" the thickness. A possible cross-sectional area range of a flattened monofilament warp strand would be from 0.07 sq. mm. to 0.5 sq. mm. and a possible ratio range of a:b would be 1.1:1 to 3:1.

The fabric of the present invention would have a warp count preferably in the range of 30 to 100 strands per inch and a weft count preferably in the range of 10 to 100 strands per inch.

We claim:

1. A dryer fabric for use in a papermaking machine comprising a plurality of interwoven warp and weft monofilament plastic polymeric strands woven with approximately 100% warp fill with edges of adjacent warp strands generally lying in common planes disposed generally normal to the plane of the fabric, at least said warp strands which extend in the machine direction, have a flattened cross-section with the long axis of said cross-section extending parallel to the plane of the fabric; the lowered profile of said flattened strands defining restricted diagonal apertures in the mesh of the fabric to thereby reduce the permeability of said fabric uniformly throughout.

2. A dryer fabric as claimed in claim 1, wherein said flattened warp strands have a width and thickness ratio in the range of approximately 1.1:1 to 3:1.

3. A dryer fabric as claimed in claim 1, wherein the permeability of said fabric is in the range of approximately 50 to 250 cu.ft./min./sq.ft. as measured with a Frasier Air Permeometer and dependent upon the cross-sectional area of said flattened warp strands.

4. A dryer fabric as claimed in claim 1, wherein said flattened warp strands have a width to thickness ratio of 2 to 1.

5. A dryer fabric as claimed in claim 1, 2 or 14, wherein said flattened warp strands are generally rectangular in cross-section.

6. A dryer fabric as claimed in claim 1, or 2, or 4, wherein at least some of the weft strands are shaped to substantially conform to the horizontally directed interstitial weft directed passages of the mesh naturally formed by the woven warp strands to thereby reduce the space between adjacent weft strands.

7. A dryer fabric as claimed in claim 1 or 2 or 4, wherein there is provided two or more layers of weft strands, said interwoven warp strands defining interstices between them in the area between adjacent ones of said weft strands, said interstices in at least one horizontal plane of the fabric forming horizontally directed passages, at least some of said horizontally directed passages having monofilament plastic polymeric weft strands extending therethrough and shaped to conform substantially to said passages so as to further reduce permeability of said fabric.

8. A dryer fabric as claimed in claim 6, wherein at least some of said weft strands are of substantially diamond shaped cross-section.

9. A dryer fabric as claimed in claim 6, wherein at least some of said weft strands are hollow.

10. A dryer fabric as claimed in claim 6, wherein at least some of said weft strands are relatively malleable as compared to the warp strands.

11. A dryer fabric as claimed in claim 1 or 2 or 4, wherein there is provided a single layer of weft strands, at least some of the said strands being shaped to conform substantially to the horizontal passages formed by the said interwoven warp strands so as to further reduce permeability of said fabric.

12. A thin low modulus of elasticity dryer fabric woven with approximately 100% warp fill with edges of adjacent warp strands generally lying in common planes disposed generally normal to the plane of the fabric and having low permeability and for use in a single fabric dryer system in which the fabric passes in serpentine fashion between upper and lower tiers of drying cylinders and supporting a paper web along its serpentine path about said cylinders, said fabric comprising a plurality of interwoven warp and weft monofilament plastic polymeric strands, at least said warp strands which extend in the machine direction, have a flattened cross-section with the long axis of said cross-section extending parallel to the plane of the fabric, the lowered profile of said flattened strands defining restricted diagonal apertures in the mesh of the fabric to thereby reduce the permeability of the fabric uniformly throughout.

13. A dryer fabric as claimed in claim 12, wherein the permeability of said fabric is in the range of approximately 50 to 250 cu.ft./min./sq.ft. as measured with a Frasier Air Permeometer and dependent upon the cross-sectional area of said flattened warp strands.

14. A dryer fabric as claimed in claim 12, wherein said modulus of elasticity is in the range of from 1500 to 3000 lbs. per inch.

15. A dryer fabric as claimed in claim 12, for use in a single fabric dryer system wherein all said drying cylinders are gear-coupled to one another through an integrated gear system.

* * * * *

UNITED STATES PATENT AND TRADEMARK OFFICE

CERTIFICATE OF CORRECTION

PATENT NO. : 4,290,209

DATED : September 22, 1981

INVENTOR(S) : John G. Buchanan et al

It is certified that error appears in the above-identified patent and that said Letters Patent are hereby corrected as shown below:

Column 1, line 67, change "drier" to read -- dryer --.

Column 3, line 52, change "run" to read -- fan --.

Column 10, line 28, change "14" to read -- 4 --.

Signed and Sealed this

*Thirteenth* Day of *April 1982*

[SEAL]

*Attest:*

GERALD J. MOSSINGHOFF

*Attesting Officer*

*Commissioner of Patents and Trademarks*